United States Patent [19]

Hannah et al.

[11] Patent Number: 4,793,652

[45] Date of Patent: Dec. 27, 1988

[54] ORTHOPAEDIC SEATING DEVICE

[75] Inventors: Richard E. Hannah, Ganges; Christine C. Stow, Victoria, both of Canada

[73] Assignee: Arbutus Society for Children, British Columbia, Canada

[21] Appl. No.: 84,442

[22] Filed: Aug. 11, 1987

[51] Int. Cl.[4] ..... A47C 7/02

[52] U.S. Cl. ..... 297/230; 297/284; 297/409; 297/410; 297/460

[58] Field of Search ..... 297/460, 230, 231, 284, 297/409, 408, 410

[56] References Cited

U.S. PATENT DOCUMENTS

| | | | |
|---|---|---|---|
| 344,726 | 6/1886 | Dolton | 297/409 X |
| 2,577,949 | 12/1951 | Barrett | 297/231 |
| 3,014,761 | 12/1961 | Otto | 297/230 |
| 3,279,849 | 10/1966 | Radke et al. | 297/284 |
| 3,542,421 | 11/1970 | Ambrose | 297/230 |
| 3,730,589 | 5/1973 | Lane | 297/284 |
| 4,234,228 | 11/1980 | Flamm | 297/284 X |
| 4,362,334 | 12/1982 | Ross et al. | 297/230 |
| 4,365,840 | 12/1982 | Kehl et al. | 297/460 |
| 4,502,728 | 3/1985 | Sheldon et al. | 297/460 |

*Primary Examiner*—Francis K. Zugel

*Attorney, Agent, or Firm*—Christie, Parker & Hale

[57] ABSTRACT

The modular orthopaedic insert of the present invention is designed to fit standard and recliner manual styles plus most powered wheelchairs. The insert can be fitted with little or no modification to the wheelchair. This allows easy transport of the insert and quick removal from the wheelchair which must be folded for vehicle transportation. The seat base and back are detachable because of the use of the current hinge design which allows customization of the insert according to the requirements of a user. For example, seats of varying widths and depths can be fitted to a standard backrest. Similarly, wider and narrower as well as longer and shorter backrests can be fitted to a standard seat base. The system is versatile and readily adjustable without the use of special tools and require a minimum of seating and/or mechanical skills to fit the system to the user and/or to the wheelchair of the user.

13 Claims, 2 Drawing Sheets

ORTHOPAEDIC SEATING DEVICE

FIELD OF THE INVENTION

This invention relates to orthopaedic devices but more particularly to a modular orthopaedic insert for use with wheelchairs.

DESCRIPTION OF THE PRIOR ART

Correct seating and positioning is essential in order to improve the independent lifestyle of those persons who must spend considerable periods of time in a wheelchair. Correct seating and accordingly better posture, has the potential of providing the user with improved physiological function, better interaction with the environment, increased ability to communicate, reduced rate of decline, and obviously greater comfort over long periods of seating time. This has the potential in turn to reduce long-term medical costs by maintaining and in some cases restoring independence to the user.

Customized seating systems adapted to meet the user's particular need have been limited in availability to the potential user due to high equipment cost and service and delivery considerations. These included the requirement for highly skilled seating personnel with shop areas able to customize the seat to a user as well as the likely necessity to modify the user's wheelchair.

There is therefore a requirement for a seating system adapted to eliminate or reduce the need for highly specialized and skilled personnel, which has a lower cost and which can make correct seating and positioning available to a much wider spectrum and number of users.

SUMMARY OF THE INVENTION

It is therefore an object of the present invention to eliminate problems associated with prior art seating systems by providing a new wheelchair insert seating system which is versatile, practical, durable and yet relatively inexpensive.

Yet another object of the present invention is to provide a wheelchair insert seating system which can be easily customized to an individual's requirements and which is readily adjustable to meet the changing needs of the individual.

Yet another object of the present invention is to provide a modular orthopaedic insert for wheelchairs which include a backrest, a seat base, movable thoracic supports and a seat cushion.

The modular orthopaedic insert of the present invention is designed to fit standard and recliner manual styles plus most powered wheelchairs. The insert can be fitted with little or no modification to the wheelchair. This allows easy transport of the insert and quick removal from the wheelchair, which must be folded for vehicle transportation. The seat base and back are detachable because of the use of the current hinge design which allows customization of the insert according to the requirements of a user. For example, seats of varying widths and depths can be fitted to a standard backrest. Similarly, wider and narrower as well as longer and shorter backrests can be fitted to a standard seat base. The system is versatile and readily adjustable without the use of special tools and requires a minimum of seating and/or mechanical skills to fit the system to the user and/or to the wheelchair of the user.

Accordingly, the present invention provides a modular orthopaedic insert for wheelchairs, comprising:

a backrest a seat base;

hinge means for removably mounting said backrest to said seat base;

adjustable thoracic support means, detachably mounted to said backrest;

securing means for mounting said thoracic support means to said backrest and adapted to permit said support means to be moved vertically and horizontally relative a vertical plane defined by said backrest; and a cushion for mounting on said base.

DESCRIPTION OF THE DRAWINGS

Particular embodiments of the invention will be understood in conjunction with the accompanying drawings in which.

DESCRIPTION OF THE PREFERRED EMBODIMENTS

Figure 1:
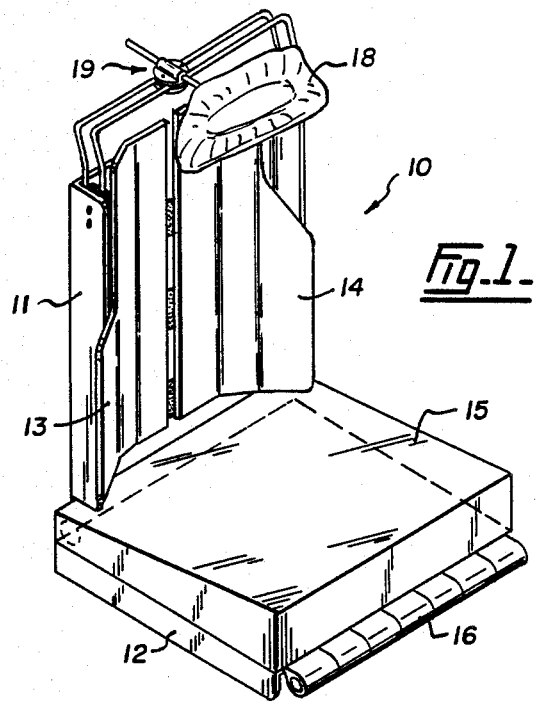
FIG. 1 is an isometric view of the seat insert of the present invention.

Referring now to FIG. 1, we have shown at reference numeral 10 the modular orthopaedic insert of the present invention. The insert is comprised of a backrest 11 hingedly mounted to a seat base 12. Secured to backrest 11 is a pair of adjustable thoracic supports 13 and 14 able to provide a necessary postural support to a user. The wedge shaped cushion 15 downwardly sloping towards the backrest, is mounted onto seat base 12.

A headrest assembly is secured to backrest 11. The headrest assembly is comprised of a headrest 18 and a support system 19 which incorporates up to four separate planes of adjustment as will be described below. Seat base 12 can be fitted with either a wedge shaped or flat cushion. The wedge shaped cushion 15 increases the support by preventing the user from sliding forward off the chair.

Figure 2:
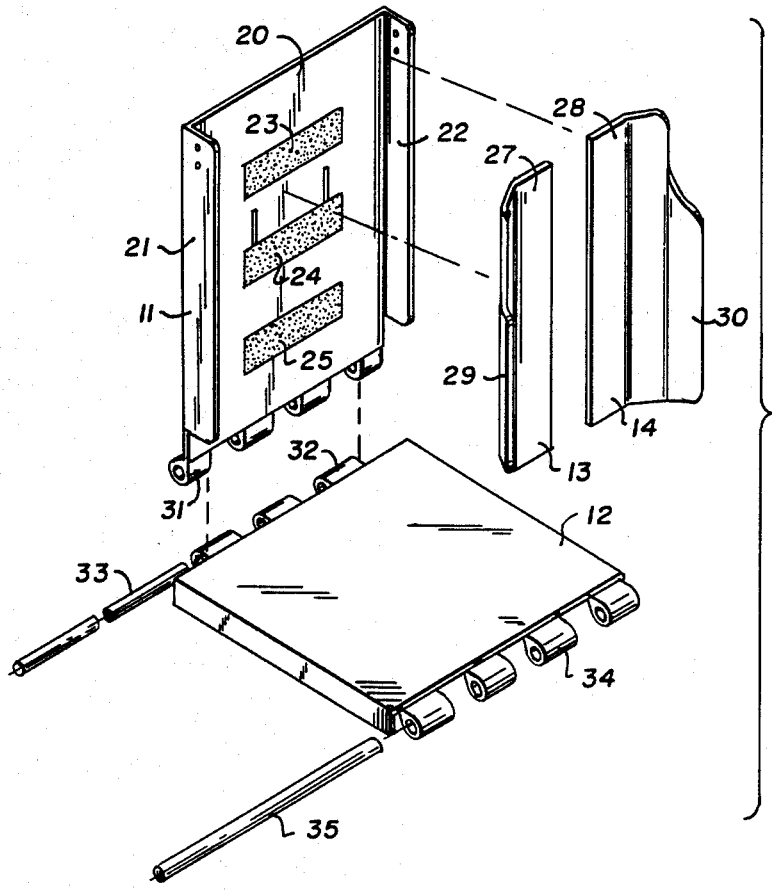
FIG. 2 is an exploded view of the main components of the seat insert.

Referring now to FIG. 2, we have shown a partially exploded view of the basic components of the orthopaedic seat inserts. Backrest 11 has a generally flat main body 20 with a pair of lateral sides 21 and 22 extending therefrom. Backrest 11 can be made material easy to mold such ABS plastic. On the inner side of backrest 11 is provided a series of dual lock TM fastening strips 23, 24 and 25. Dual-lock TM fasteners are industrial grade hook and loop fasteners. These allow a user to select and secure the precise positioning of strips 23, 24 and 25. Dual-lock TM fasteners are industrial grade hook and loop fasteners. These allow a user to select and secure the precise positioning of thoracic supports 13 and 14 according to the individual's particular requirement.

Thoracic supports 13 and 14 are made of thin sheets of ABS plastic and include a flat section 27 and 28 respectively adapted to receive Dual-lock TM fastening strips corresponding to fastening strips 23, 24 and 25. Each thoracic support has a generally curved configuration provided by raised sides 29 and 30. Raised sides 29 and 30 extend partially from the bottom of the support to a point near the top. The thoracic supports are made comfortable with foam padded upholstered pads. A lumbar pad or pads can accommodate various spinal problems when placed between the thoracic supports and upholstered pads.

Backrest 11 is secured to seat base 12 by means interlinking tubular sections 31 and 32. These are secured and aligned together by means of a tubular member 33 inserted therein. At the front end of seat base 12, cushion 15 can be secured to seat base 12, if desired, using hinge 16. Hinge 16 comprises interlinking tubular sections 34 attached to seat base 12 and a corresponding set of interlinking tubular sections on cushion 15. Cushion 15 can be secured to seat base 12 by aligning the interlinking tubular sections and locking them into place using tubular member 35. Interlinking tubular sections 34 at the front end of seat base 12 and a corresponding tubular member 35. These interlinking tubular sections or more commonly called piano type hinges can also be made of ABS plastic.

Figure 3:
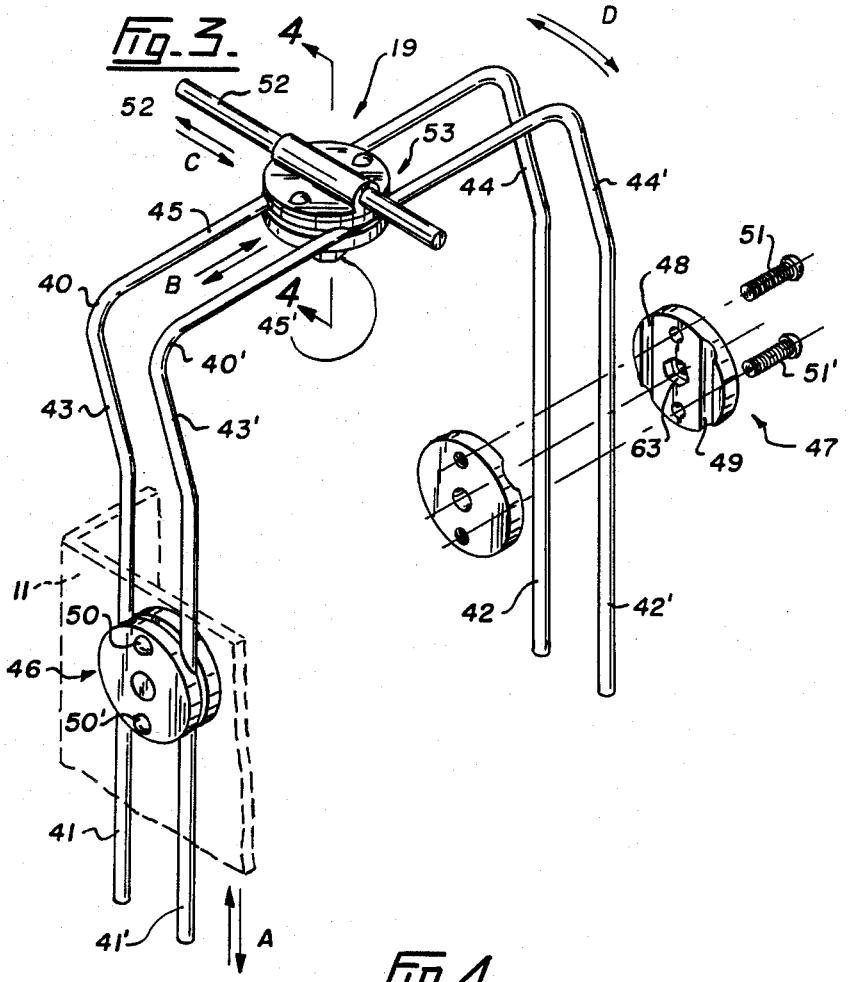
FIG. 3 is an isometric and partially exploded view of the headrest and adjustment system of the present invention.

Referring now to FIG. 3 we have shown a partially exploded view of the headrest support system 19 of the present invention. This support allows a headrest to be adjusted in four separate planes. For example, the headrest can be adjusted upwardly and downwardly relative backrest 11 as depicted by arrows A, sideways from one side of the backrest to another as depicted by arrows B, forward and backward relative to backrest 11 as depicted by arrows C and rotated about an axis defined by a plane lying parallel to backrest 11 as depicted by arrows D.

The headrest support system 19 is basically comprised a first pair of rods 40 and 40' positioned adjacent and parallel each other and having straight sections 41, 41', 42 and 42' extending along each side of backrest 11. First and second straight sections 41, 41', 42 and 42' extend upwardly to an angled set of sections 43, 43', 44 and 44', respectively, which extend rearwardly to a third set of straight sections 45 and 45' perpendicular to the first and second section and extending therebetween. The angled sections allow the headrest to be positioned rearwardly of backrest 11 and thereby allow a greater range of support for the patients head. The first and second straight sections 41, 41', 42 and 42' respectively are adjustably secured to backrest 11 by means of a set of disc shaped connecting members 46 and 47 respectively. These connecting members allow support rods 40 and 40' to be moved upwardly and downwardly relative to backrest 11.

Each disc shaped connecting member is comprised of a pair of discs each formed with a pair of circular channels 48 and 49 on the internal face of the disc adapted to lie adjacent a channel formed face of an adjacent disc. Each disc in a pair of discs are secured together by means of threaded fasteners 50, 50', 51 and 51'.

The headrest support rod 52 is adjustably mounted to rod section 45 and 45' of support rod 40 and 40' by means of a similar disc shaped connecting member shown generally at reference numeral 53. Connecting member 53 allows the adjustment of the headrest along the planes defined by arrows B and C.

Figure 4:
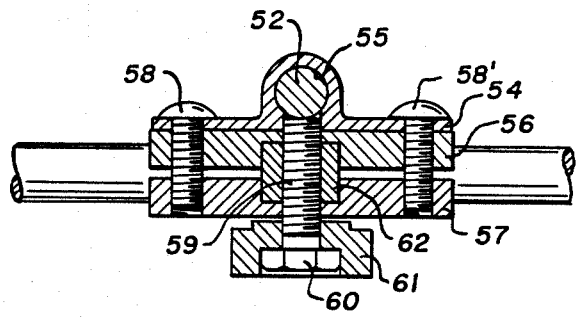
FIG. 4 is a sectional view taken along lines 4—4 of FIG. 3.

Referring now to FIG. 4, we have shown a sectional view of connecting member 53.

The connecting member is comprised of a first connecting plate 54 with an integral tubular sleeve 55 adapted to receive headrest support rod 52. Connecting plate 54 is securely mounted to a pair of discs 56 and 57, each provided with circular channels formed on the internal face of the disc and adapted to receive the third straight sections 45 and 45' of the support assembly. Connecting plate 54 is secured to discs 55 and 56 by means of threaded fasteners 58 and 58'. Tubular channel 55 is provided with a cavity adapted to receive the end of a threaded stud 59 having an hexagonal head 60 to allow rotation of stud 59 by means of adjustment knob 61. A threaded nut 62 is centrally located between discs 56 and 57 in an hexagonal shaped recess such as shown at reference numeral 63 in FIG. 3.

Adjustment of the headrest assembly can be achieved by tightening fasteners 58 and 58' and adjustment knob 61. For example, adjustments in the plane depicted by arrows C can be made by untightening knob 61 to allow the rod 52 to be moved through the assembly. Rod 52 with attached headrest 18 (FIG. 1) can be removed completely from the assembly if desired.

Similarly, adjustment of the headrest assembly in the plane defined by arrows B can be made by untightening fasteners 58 and 58'. Compressive tension between the upper and lower discs is decreased thereby allowing movement of the assembly along rods 45 and 45'.

In order to adjust the headrest in the plane defined by arrows D, discs 46 and 47 are loosened thereby allowing each individual rod to be moved to the required position: i.e. a first rod 45 moved upwardly and a second rod 45' moved downwardly thereby pivoting rod 52 and a headrest downwardly. In addition, discs 46 and 47 allow the headrest assembly to be adjusted upwardly and downwardly along the plane defined by arrows A.

We claim:

1. A modular orthopaedic insert for wheelchairs, comprising, in combination:

a backrest;

a seat base;

hinge means for removably mounting said backrest to said seat base;

adjustable thoracic support means, detachably mounted to said backrest;

securing means for mounting said thoracic support means to said backrest and adapted to permit said support means to be moved vertically and horizontally relative to a vertical plane defined by said backrest;

a cushion for mounting on said seat base; and an adjustable headrest attached to said backrest comprising a pair of spaced rods positioned adjacent and parallel each other, each of said rods being formed with first and second depending straight sections joined by a third straight section perpendicular to said first and second sections and extending therebetween;

first connecting means mounted to said backrest for slidably receiving said first and second depending straight sections of said pair of spaced rods;

a headrest connected to a headrest support rod; and second connecting means for slidably receiving said headrest support rod, said second connecting means being slidably mounted between said third straight sections of said pair of spaced rods.

2. A modular orthopaedic insert as defined in claim 1 wherein said hinge means comprises interlinking tubular sections adapted to receive a tubular member to attach interlinking tubular sections of said backrest to interlinking tubular sections of said seat base.

3. A modular orthopaedic insert as defined in claim 1 wherein said securing means comprises hook and loop fastening means.

4. A modular orthopaedic insert as defined in claim 3 wherein said hook and loop fastening means comprises a series of strips of hook and loop fasteners laid out along said backrest and said thoracic support means.

5. A modular orthopaedic insert as defined in claim 1 wherein said thoracic support means comprises a pair of thoracic supports having a generally flat and elongated body each having a raised side configuration adapted to provide thoracic support to a user.

6. A modular orthopaedic insert as defined in claim 5 wherein each of said supports has at least one flat section thereof with hook and loop fasteners thereon adapted to lie parallel with said backrest and adapted to be secured with a correponding hook and loop fastener.

7. A modular orthopaedic insert as defined in claim 1 wherein said cushion is wedge shaped and sloping downwardly towards said backrest.

8. An adjustable headrest for attachment to the backrest of a seat comprising:

a pair of spaced rods positioned adjacent and parallel each other, each of said rods being formed with first and second depending straight sections joined by a third straight section substantially perpendicular to said first and second sections and extending therebetween;

first connecting means mounted to said backrest for slidably receiving said first and second depending straight sections of said pair of spaced rods;

a headrest connected to a headrest support rod; and second connecting means for slidably receiving said headrest support rod, said second connecting means being slidably mounted between said third straight sections of said pair of spaced rods.

9. An adjustable headrest as defined in claim 8 wherein said first connecting means comprises a pair of connecting members positioned on either side of the backrest of the seat.

10. An adjustable headrest as defined in claim 9 wherein each of said connecting members comprises a pair of opposed plates connected together by fastening means, each plate being formed with aligned channels on faces thereof adapted to lie adjacent each other, said aligned channels receiving said first and second depending straight sections of said pair of rods and allowing for slidable movement of said straight sections when said fastening means is loosened, and clamping engagement of said straight sections when said fastening means is tightened to bring said plate faces together.

11. An adjustable headrest as defined in claim 8 wherein said second connecting means comprises a pair of opposed plates connected together by fastening means, each plate being formed with aligned channels on faces thereof adapted to lie adjacent each other, said aligned channels receiving said third straight sections of said pair of rods, and a connecting plate mounted atop said opposed plates having an integral tubular channel to receive said headrest support rod.

12. An adjustable headrest as defined in claim 11 wherein a threaded radially extending passage communicates with said integral tubular channel and houses a threaded member extendable into said tubular passage for clamping engagement of said headrest support rod.

13. An adjustable headrest as defined in claim 8 wherein each of said pair of spaced rods is formed with first and second angled sections extending from said first and second straight sections in a plane at an angle to the plane of said first and second straight sections, said first and second angled sections being joined by said third straight section extending therebetween.

* * * * *